US008737878B2

(12) United States Patent
Yamaguchi et al.

(10) Patent No.: US 8,737,878 B2
(45) Date of Patent: May 27, 2014

(54) IMAGE FORMING APPARATUS INCLUDING REMOVABLE FIXING DEVICE

(75) Inventors: Yoshiki Yamaguchi, Kanagawa (JP); Akira Shinshi, Tokyo (JP); Kenichi Hasegawa, Kanagawa (JP); Hiroshi Yoshinaga, Chiba (JP); Naoki Iwaya, Tokyo (JP); Ippei Fujimoto, Kanagawa (JP); Yutaka Ikebuchi, Kanagawa (JP); Shuntaroh Tamaki, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 192 days.

(21) Appl. No.: 13/048,160

(22) Filed: Mar. 15, 2011

(65) Prior Publication Data

US 2011/0229200 A1 Sep. 22, 2011

(30) Foreign Application Priority Data

Mar. 16, 2010 (JP) ..... 2010-059115

(51) Int. Cl.
*G03G 15/16* (2006.01)

(52) U.S. Cl.
USPC ..... 399/122

(58) Field of Classification Search
USPC ..... 399/122
See application file for complete search history.

(56) References Cited

U.S. PATENT DOCUMENTS 6,131,009 A 10/2000 Hasegawa
6,496,666 B2 12/2002 Hayashi et al.
6,591,081 B2 7/2003 Hasegawa
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.

(Continued)

FOREIGN PATENT DOCUMENTS

CN 1752867 A 3/2006
CN 101093382 A 12/2007

(Continued)

OTHER PUBLICATIONS

U.S. Appl. No. 12/876,589, filed Sep. 7, 2010, Masanao Ehara, et al.

(Continued)

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

An image forming apparatus includes a fixing device, a temperature detector, and a support member. The fixing device is removably installable in the image forming apparatus and includes a rotary fixing member to fuse a toner image on a recording medium, a fixing frame to support the fixing member, and an outer fixing cover provided to cover the fixing member and the fixing frame and having an opening from which a portion of a surface of the fixing member is exposed to the outside. The temperature detector is disposed opposing the fixing member to detect a temperature of the surface of the fixing member without contacting the fixing member when the fixing member is installed in the image forming apparatus. The support member supports the temperature detector to introduce the temperature detector into the inside of the fixing cover through the opening upon installation of the fixing member.

5 Claims, 4 Drawing Sheets

(56) References Cited

U.S. PATENT DOCUMENTS

| | | | | |
|---|---|---|---|---|
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 7,022,944 | B2 | 4/2006 | Yoshinaga et al. | |
| 7,070,182 | B2 | 7/2006 | Hasegawa | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,593,680 | B2 | 9/2009 | Shinshi | |
| 7,630,652 | B2 | 12/2009 | Hasegawa | |
| 7,702,271 | B2 | 4/2010 | Yamada et al. | |
| 7,742,714 | B2 | 6/2010 | Shinshi et al. | |
| 7,840,151 | B2 | 11/2010 | Fujimoto | |
| 7,869,753 | B2 | 1/2011 | Shinshi | |
| 2003/0227533 | A1* | 12/2003 | Yokoi | 347/156 |
| 2006/0029411 | A1 | 2/2006 | Ishii et al. | |
| 2006/0239706 | A1* | 10/2006 | Dan | 399/70 |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0059071 | A1 | 3/2007 | Shinshi et al. | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0028595 | A1* | 1/2009 | Yano | 399/69 |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0311016 | A1* | 12/2009 | Shinshi | 399/329 |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0013950 | A1 | 1/2011 | Furuya et al. | |
| 2011/0026987 | A1 | 2/2011 | Hasegawa | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |

FOREIGN PATENT DOCUMENTS

| | | | |
|---|---|---|---|
| JP | 2002-139952 | | 5/2002 |
| JP | 2004-13024 | A | 1/2004 |
| JP | 2007-199614 | A | 8/2007 |
| JP | 2010-26489 | A | 2/2010 |

OTHER PUBLICATIONS

U.S. Appl. No. 12/888,980, filed Sep. 23, 2010, Kenichi Hasegawa, et al.
U.S. Appl. No. 12/881,547, filed Sep. 14, 2010, Naoki Iwaya, et al.
U.S. Appl. No. 12/880,327, filed Sep. 13, 2010, Ryota Yamashina, et al.
U.S. Appl. No. 12/878,686, filed Sep. 9, 2010, Akiyasu Amita, et al.
U.S. Appl. No. 12/893,361, filed Sep. 29, 2010, Kenichi Hasegawa, et al.
U.S. Appl. No. 12/946,276, filed Nov. 15, 2010, Masaaki Yoshikawa, et al.
U.S. Appl. No. 12/946,374, filed Nov. 15, 2010, Kenji Ishii, et al.
Japanese Office Action issued Oct. 29, 2013 in Patent Application No. 2010-059115.

* cited by examiner

IMAGE FORMING APPARATUS INCLUDING REMOVABLE FIXING DEVICE

CROSS-REFERENCE TO RELATED APPLICATIONS

The present patent application claims priority pursuant to 35 U.S.C. §119 from Japanese Patent Application No. 2010-059115, filed on Mar. 16, 2010 in the Japan Patent Office, which is hereby incorporated herein by reference in its entirety.

BACKGROUND

1. Field

Exemplary embodiments of the present disclosure relate to an image forming apparatus, such as a copier, a printer, a facsimile machine, and a multifunctional device having at least two of the foregoing capabilities, and more specifically, to an image forming apparatus including a removable fixing device.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. In such an image forming apparatus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device employed in an image forming apparatus may include a non-contact-type temperature detector to detect the surface temperature of a fixing member (e.g., heating roller).

For example, for an image forming apparatus like that described in JP-2002-139952-A, a thermopile serving as the temperature detector is disposed opposing a heating roller serving as the fixing member without contacting the heating roller. In accordance with a temperature detected by the thermopile, the output of the heater within the heating roller is controlled to adjust the surface temperature (fixing temperature) of the heating roller. The thermopile is disposed outside the fixing device in the image forming apparatus to minimize temperature increase of the thermopile itself. Thus, the thermopile is disposed opposing the heating roller outside the fixing device to control the temperature of the heating roller.

For the above-described conventional art, a non-contact-type temperature detector is used to detect the surface temperature of the fixing member. Such a configuration has an advantage over a contact-type temperature detector (e.g., contact-type thermistor) for detecting the surface temperature of the fixing member in contact with the surface of the fixing member, in that the fixing member and the temperature detector are not worn by sliding contact of the fixing member with the temperature detector. In addition, the costly, non-contact-type temperature detector is disposed outside the fixing device in the image forming apparatus. Such a configuration is advantageous in that it is possible to reduce the production cost of the fixing device which is replaced more often than the entire image forming apparatus. However, by locating the non-contact-type temperature detector outside the fixing device, the temperature detector may be affected by air flow in the image forming apparatus. As a result, the ambient temperature around the temperature detector may be disturbed, thus preventing precise detection of the surface temperature of the fixing member. In such a case, the fixing temperature of the fixing member may fluctuate, resulting in fixing failure of a resultant image.

SUMMARY

In an aspect of this disclosure, there is provided an improved image forming apparatus including a fixing device, a temperature detector, and a support member. The fixing device is removably installable in the image forming apparatus and includes a rotary fixing member to thermally fuse a toner image on a recording medium, a fixing frame to directly or indirectly support the rotary fixing member, and an outer fixing cover provided to cover the rotary fixing member and the fixing frame and having an opening from which a portion of a surface of the rotary fixing member is exposed to the outside of the fixing device. The temperature detector is disposed opposing the rotary fixing member to detect a temperature of the surface of the rotary fixing member without contacting the rotary fixing member when the rotary fixing member is installed in the image forming apparatus. The support member supports the temperature detector to introduce the temperature detector into the inside of the outer fixing cover through the opening upon installation of the rotary fixing member in the image forming apparatus.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
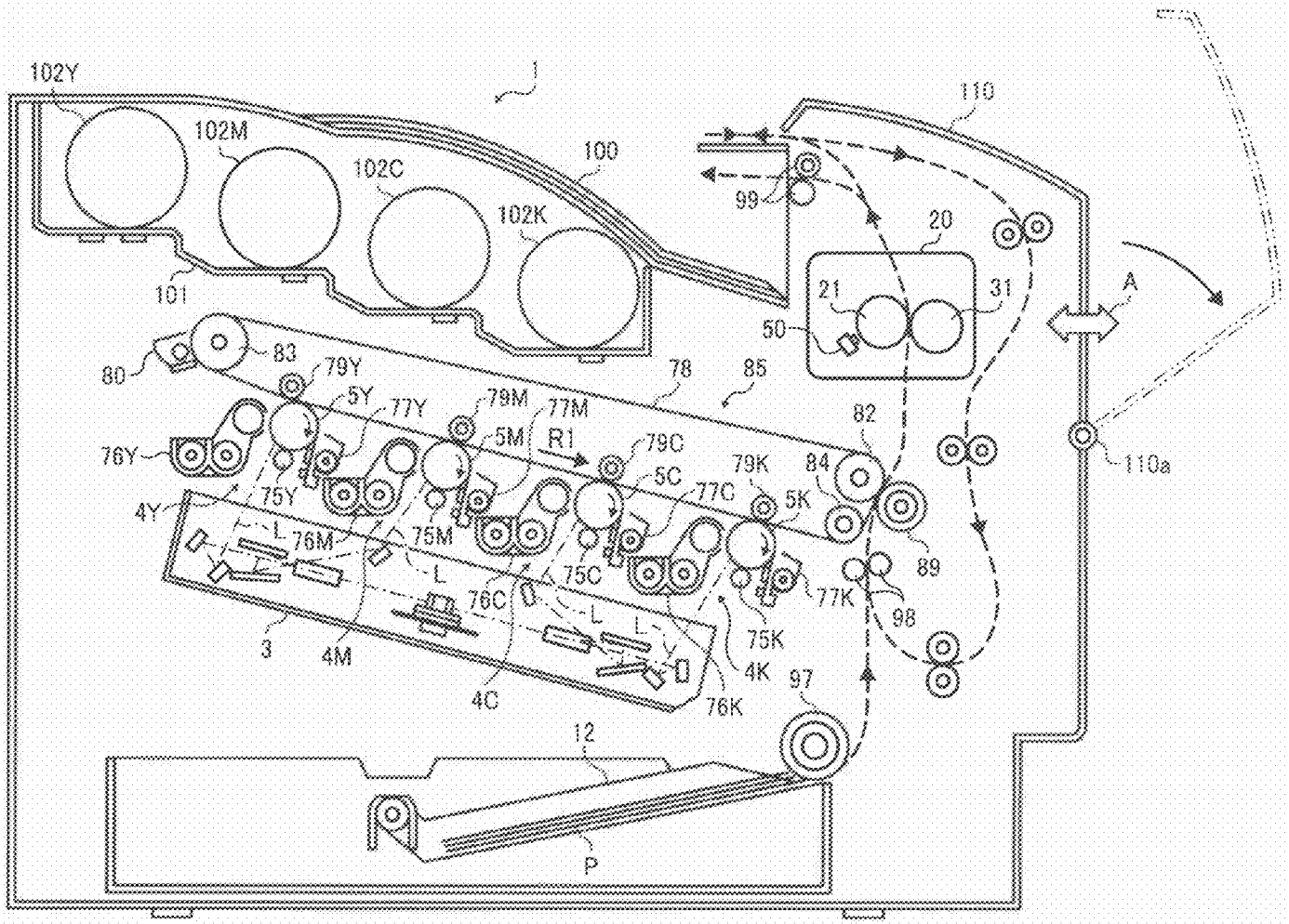
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, a state in which, for example, a stationary member, a metal member, or a reinforcement member is "fixedly provided" refers to a state in which the stationary member, the metal member, or the reinforcement member is not rotationally driven and supported so as not to rotate. Therefore, for example, even in a case in which the stationary member is biased toward a fixing nip by a biasing member, e.g., a spring, the stationary member is "fixedly provided" if the stationary member is supported so as not to rotate.

Referring now to the drawings, wherein like reference numerals designate identical or corresponding parts throughout the several views, in particular to FIG. 1, an image forming apparatus 1 according to an exemplary embodiment of the present disclosure is described.

First Exemplary Embodiment

An exemplary embodiment of the present disclosure is described with reference to FIGS. 1 to 5.

First, configuration and operation of the image forming apparatus 1 are described with reference to FIG. 1. In FIG. 1, the image forming apparatus 1 is a tandem color printer for forming a color image on a recording medium. However, it is to be noted that the image forming apparatus may be any other suitable type of image forming apparatus, such as a copier, a facsimile machine, a printer, or a multifunction printer having at least one of copying, printing, scanning, plotter, and facsimile functions.

A toner bottle holder 1 is provided in an upper portion of the image forming apparatus 1. Four toner bottles 102Y, 102M, 102C, and 102K contain yellow, magenta, cyan, and black toners, respectively, and are removably installed in the toner bottle holder 101 so that the toner bottles 102Y, 102M, 102C, and 102K are replaceable, respectively.

An intermediate transfer unit 85 is provided below the toner bottle holder 101. Image forming devices 4Y, 4M, 4C, and 4K are arranged opposite an intermediate transfer belt 78 of the intermediate transfer unit 85, and form yellow, magenta, cyan, and black toner images, respectively.

The image forming devices 4Y, 4M, 4C, and 4K include photoconductive drums 5Y, 5M, 5C, and 5K, respectively. Further, chargers 75Y, 75M, 75C, and 75K, development devices 76Y, 76M, 76C, and 76K, cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, an exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The intermediate transfer unit 85 includes the intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed on the intermediate transfer belt 78 reaches the second transfer nip. At the second transfer nip, a second transfer roller 89 and the second transfer backup roller 82 sandwich the intermediate transfer belt 78. The second transfer roller 89 transfers the color toner image formed on the intermediate transfer belt 78 onto the recording medium P fed by a registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78.

Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

A paper tray 12 is provided in a lower portion of the image forming apparatus 1, and loads a plurality of recording media P (e.g., transfer sheets). A feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing belt 21 (serving as a fixing member) and a pressing roller 31 apply heat and pressure to the recording medium P to fix the color toner image on the recording medium P. An output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

In this exemplary embodiment, the fixing device (fixing unit) 20 is removably (replaceably) installed in the image forming apparatus 1. For example, as illustrated in FIG. 1, by pivoting a cover 110 around a hinge 110*a*, an install portion of the fixing device 20 is exposed. By moving the fixing device 20 to and from the install portion in directions indicated by a double blank arrow A in FIG. 1, the fixing device 20 is installed in and removed from the image forming apparatus 1. Such installation and removal are performed, for example, when the fixing device 20 is replaced or serviced (e.g., for replacement or adjustment of some components).

In this exemplary embodiment, a temperature sensor 50 (temperature detector) for detecting the surface temperature of the fixing belt 21 (fixing member) of the fixing device 20 is provided not at the fixing device 20 but at the image forming apparatus 1.

Referring to FIGS. 2 to 5, the following describes the structure and operation of the fixing device 20 removably installed in the image forming apparatus 1.

As illustrated in FIGS. 2 to 5, the fixing device 20 includes the fixing belt 21 serving as a fixing member or a belt member, a stationary member 26, a metal member 22 serving as a heating member, a reinforcement member 23, a heater 25 serving as a heat source, the pressing roller 31 serving as a rotary pressing member, a heat insulator 27, and a stay 28.

Figure 2:
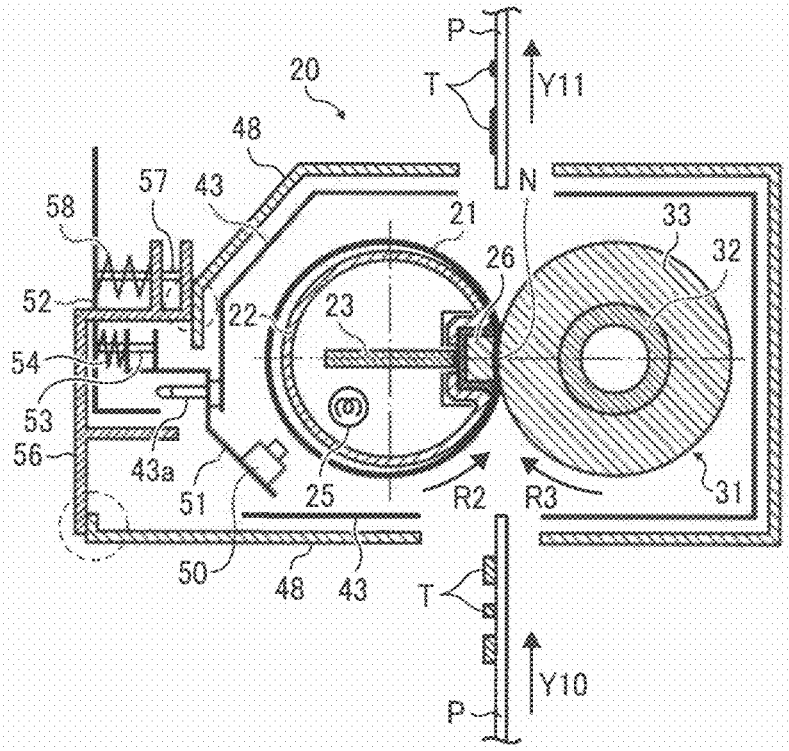
FIG. 2 is a schematic view of a state in which a fixing device is installed in the image forming apparatus illustrated in FIG. 1.

The fixing belt 21 may be a thin, flexible endless belt that rotates or moves counterclockwise in FIG. 2, i.e., in a rotation direction R2 indicated by an arrow in FIG. 2. The fixing belt 21 is constructed of a base layer, an intermediate elastic layer, and a surface release layer, and has a total thickness not greater than approximately 1 mm.

The base layer includes an inner circumferential surface 21*a* serving as a sliding surface which slides over the stationary member 26. The elastic layer is provided on the base layer.

The release layer is provided on the elastic layer. The base layer of the fixing belt 21 has a thickness in a range of from approximately 30 μm to approximately 50 μm, and includes a metal material such as nickel and/or stainless steel, and/or a resin material such as polyimide.

The elastic layer of the fixing belt 21 has a thickness in a range of from approximately 100 μm to approximately 300 μm, and includes a rubber material such as silicon rubber, silicon rubber foam, and/or fluorocarbon rubber. The elastic layer eliminates or reduces slight surface asperities of the fixing belt 21 at a nip N formed between the fixing belt 21 and the pressing roller 31. Accordingly, heat is uniformly transmitted from the fixing belt 21 to a toner image T on a recording medium P, preventing formation of a rough image such as an orange peel image. In this exemplary embodiment, the elastic layer of the fixing belt 21 is made of, for example, silicone rubber of a thickness of approximately 200 μm.

The release layer of the fixing belt 21 has a thickness in a range of from approximately 10 μm to approximately 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The diameter of the fixing belt 21 is set to approximately 15 mm to approximately 120 mm. In this exemplary embodiment, the fixing belt 21 has an inner diameter of, for example, approximately 30 mm.

Figure 3:
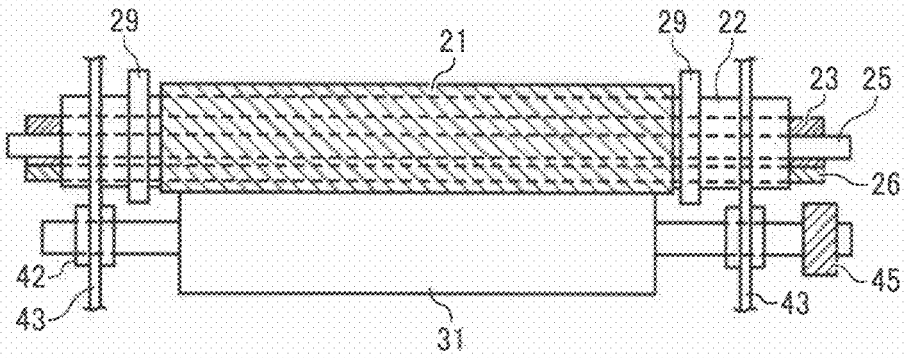
FIG. 3 is a front view of the fixing device of FIG. 2 in an axial direction thereof.
Figure 4:
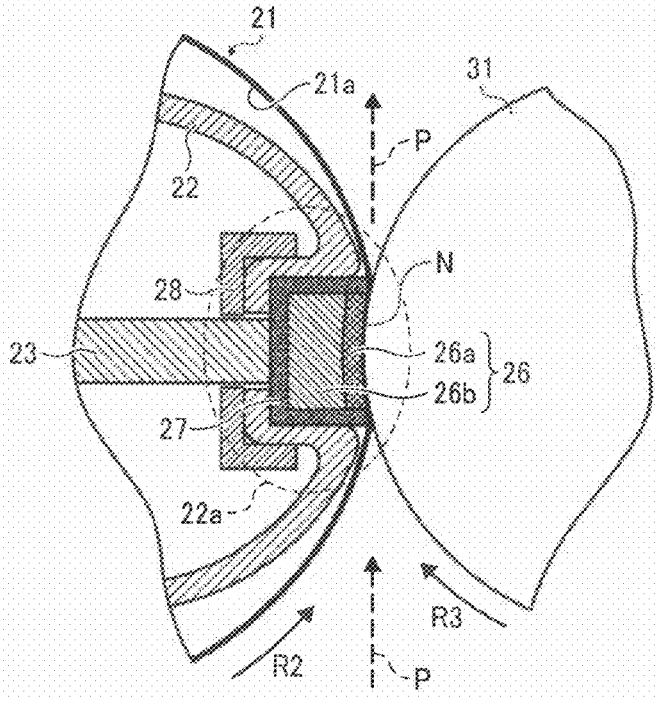
FIG. 4 is an enlarged view of a nip and its neighboring area of the fixing device of FIG. 2.

As illustrated in FIGS. 2 to 4, the stationary member 26, the heater 25, the metal member 22, the reinforcement member 23, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21. A lubricant intervenes between the fixing belt 21 and the metal member 22.

The stationary member 26 is fixed inside the fixing belt 21 in such a manner that the inner circumferential surface 21*a* of the fixing belt 21 slides over the stationary member 26. The stationary member 26 is pressed by the pressing roller 31 with the fixing belt 21 sandwiched between the stationary member 26 and the pressing roller 31 to form the nip N between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by a fixing frame 43 of the fixing device 20, respectively. The configuration of the stationary member 26 is described in more detail below.

As illustrated in FIG. 2, the metal member 22 has a substantially cylindrical shape. The metal member 22 serving as a heating member directly faces the inner circumferential surface 21*a* of the fixing belt 21 at a position other than the nip N. At the nip N, the metal member 22 holds the stationary member 26 via the heat insulator 27. As illustrated in FIG. 3, both ends of the metal member 22 in an axial direction of the metal member 22 parallel to the axial direction of the fixing belt 21 are mounted on and supported by the fixing frame 43 of the fixing device 20, respectively. The flanges 29 are provided on both ends of the metal member 22 in the axial direction of the metal member 22 to restrict movement (e.g., shifting) of the fixing belt 21 in the axial direction of the fixing belt 21. Thus, the fixing belt 21 is indirectly supported by the fixing frame 43 via the metal member 22 and the flanges 29.

The substantially-cylindrical metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than approximately 0.1 mm to maintain desired heating efficiency for heating the fixing belt 21. The metal member 22 may include a metal thermal conductor, that is, a metal having thermal conductivity, such as stainless steel, nickel, aluminum, and/or iron.

Preferably, the metal member 22 may include ferrite stainless steel having a relatively smaller heat capacity per unit volume obtained by multiplying density by specific heat. In this exemplary embodiment, the metal member 22 includes, for example, SUS430 stainless steel as ferrite stainless steel and has a thickness of, for example, 0.1 mm.

The heater 25 may be a halogen heater and/or a carbon heater. As illustrated in FIG. 3, both ends of the heater 25 in a width direction of the heater 25 parallel to the axial direction of the fixing belt 21 are fixedly mounted on the fixing frame 43 of the fixing device 20, respectively. Radiation heat generated by the heater 25, which is controlled by a power source provided in the image forming apparatus 1 illustrated in FIG. 1, heats the metal member 22. The metal member 22 heats substantially the entire fixing belt 21. In other words, the metal member 22 heats a portion of the fixing belt 21 other than the nip N. Heat is transmitted from the heated outer circumferential surface of the fixing belt 21 to the toner image T on the recording medium P.

As illustrated in FIG. 2, the non-contact-type temperature sensor 50 (temperature detector) faces the outer circumferential surface of the fixing belt 21 to detect a temperature of the outer circumferential surface of the fixing belt 21. A controller controls the heater 25 according to detection results provided by the temperature sensor 50 so as to adjust the temperature (e.g., fixing temperature) of the fixing belt 21 to a desired temperature. The non-contact-type temperature sensor 50 is, for example, a thermopile or a non-contact-type thermistor, and is provided not at the fixing device 20 but at the image forming apparatus 1.

As described above, for the fixing device 20 according to this exemplary embodiment, the metal member 1 does not heat a small part of the fixing belt 21 but heats substantially the entire fixing belt 21 in a circumferential direction of the fixing belt 21. Accordingly, even when the image forming apparatus 1 illustrated in FIG. 1 forms a toner image at high speed, the fixing belt 21 is heated enough to prevent fixing failure. In other words, the relatively simple structure of the fixing device 20 heats the fixing belt 21 efficiently, resulting in a shortened warm-up time, a shortened first print time, and the downsized image forming apparatus 1.

The substantially-cylindrical metal member 22 is fixedly provided in the fixing device 20 opposite the fixing belt 21 in such a manner that a certain clearance is provided between the inner circumferential surface 21*a* of the fixing belt 21 and the metal member 22 over an area along the inner surface of the fixing belt 21 except for where the nip N is formed. The clearance δ, that is, a gap between the fixing belt 21 and the metal member 22 at the area along the inner surface of the fixing belt 21 other than the nip N, is not greater than 1 mm, expressed as $0\ \text{mm} < \delta = < 1\ \text{mm}$. Accordingly, the fixing belt 21 does not slidably contact the metal member 22 over an increased area, thus minimizing wearing of the fixing belt 21. At the same time, the clearance provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

A lubricant, such as fluorine grease or silicone oil, is applied between the inner circumferential surface 21*a* of the fixing belt 21 and the metal member 22, so as to decrease wearing of the fixing belt 21 as the fixing belt 21 slidably contacts the metal member 22.

In this exemplary embodiment, the metal member 22 has a cross section of a substantially circular shape. Alternatively, the metal member 22 may have a cross section of a polygonal shape.

As illustrated in FIG. 2, the reinforcement member 23 reinforces the stationary member 26 which forms the nip N between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the fixing frame 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip N. Specifically, as illustrated in FIG. 2, the reinforcement member 23 is a plate member that is disposed so as to divide the interior of the metal member 22 into substantially two spaces.

In order to provide the above-described capabilities, the reinforcement member 23 may include metal material having great mechanical strength, such as stainless steel and/or iron. In this exemplary embodiment, the reinforcement member 23 includes, for example, SUS304 (or SUS403) of a thickness of approximately 1.5 mm to approximately 2 mm.

Further, an opposing face of the reinforcement member 23 which faces the heater 25 may include a heat insulation material partially or wholly. Alternatively, the opposing face of the reinforcement member 23 disposed opposite the heater 25 may be mirror-ground. Accordingly, heat radiated by the heater 25 toward the reinforcement member 23 to heat the reinforcement member 23 is used to heat the metal member 22, improving heating efficiency for heating the metal member 22 and the fixing belt 21.

As illustrated in FIG. 2, the pressing roller 31 serves as a rotary pressing member for contacting and pressing against the outer circumferential surface of the fixing belt 21 at the nip N. The pressing roller 31 has an outer diameter of approximately 30 mm. In the pressing roller 31, an elastic layer 33 having a thickness of, for example, approximately 3 mm is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip N between the pressing roller 31 and the fixing belt 21. As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the fixing frame 43 of the fixing device 20 via the bearings 42, respectively.

When the elastic layer 33 of the pressing roller 31 includes a sponge material such as silicon rubber foam, the pressing roller 31 applies decreased pressure to the fixing belt 21 at the nip N to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

In this exemplary embodiment, the diameter of the fixing belt 21 is substantially identical to the diameter of the pressing roller 31. Alternatively, the diameter of the fixing belt 21 is may be smaller than the diameter of the pressing roller 31. In such a case, the curvature of the fixing belt 21 is smaller than the curvature of the pressing roller 31, thus allowing the recording medium P discharged from the nip N to be smoothly separated from the fixing belt 21. In order to enhance the efficiency in heating the fixing belt 21, the fixing device may include a heat source to directly heat the pressing roller 31. For example, such a heater may be provided within a metal core of the pressing roller 31.

As illustrated in FIG. 4, the inner circumferential surface 21*a* of the fixing belt 21 slides over the stationary member 26. The stationary member 26 includes a surface layer 26*a* disposed on a base layer 26*b*. An opposing face (sliding-contact face) of the stationary member 26 facing the pressing roller 31 has a concave shape of a curvature substantially identical to the curvature of the pressing roller 31. Thus, the recording medium P is discharged from the nip N substantially along the curvature of the pressing roller 31, preventing a failure, such as non-separation of the recording medium P from the fixing belt 21 after the fixing process.

As described above, in this exemplary embodiment, the stationary member 26 forming the nip N has a concave shape. Alternatively, the stationary member 26 may have a flat shape. In other words, the sliding-contact surface of the stationary member 26 that opposes the pressing roller 31 may be formed in flat shape. For such a configuration, the shape of the nip is substantially parallel to an image recorded face of the recording medium P. As a result, the fixing belt 21 comes into closer contact with the recording medium P, thus enhancing fixing performance. In addition, the curvature of the fixing belt 21 is relatively large at the exit side of the nip, thus facilitating smooth separation of the recording medium P from the nip.

The base layer 26*a* of the stationary member 26 includes a rigid material so that the stationary member 26*b* is not bent substantially by pressure applied by the pressing roller 31. In this exemplary embodiment, the base layer 26*b* is made of, for example, aluminum of a thickness of approximately 1.5 mm.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip N, degrading fixing property. To address such a challenge, in this exemplary embodiment, the rigid stationary member 26 is provided separately from the thin metal member 22 to help form and maintain the proper nip N.

The surface layer 26*a* of the stationary member 26 is a low friction material such as fluorocarbon rubber. Such a configuration can form a desired nip between the stationary member 26 and the fixing belt 21 while minimizing wear of the fixing belt 21 and the stationary member 26 due to sliding contact of the stationary member 26 with the fixing belt 21. In this exemplary embodiment, the surface layer 26*a* has a thickness of approximately 1.5 and approximately 2 mm.

Further, the surface layer 26*a* may be preliminarily impregnated with the lubricant. Thus, the lubricant is retained at the surface of the stationary member 26 contacting the fixing belt 21, thus minimizing wearing of the stationary member 26 and the fixing belt 21.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

In this exemplary embodiment, the metal member 22 is disposed in proximity to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In conventional on-demand fixing devices, when heat is applied to the deformed pressing roller 31 at the nip N in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip N, generating faulting fixing or noise in accordance with rotation of the pressing roller 31.

To address those challenges, according to this exemplary embodiment, the heat insulator 27 is provided between the stationary member 26 and the metal member 22 to reduce heat transmitted from the metal member 22 to the stationary member 26 in the standby mode, preventing the deformed pressing roller 31 from being heated at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip N, resulting in unstable slippage of the fixing belt 21 over the stationary member 26.

To address this problem, according to this exemplary embodiment, the heat insulator 27 is provided between the stationary member 26 and the metal member 22 to reduce heat transmitted from the metal member 22 to the lubricant at the nip N, thus reducing deterioration of the lubricant due to high temperature.

In this exemplary embodiment, the heat insulator 26 provided between the stationary member 26 and the metal member 22 insulates the stationary member 26 from the metal member 22. Accordingly, the metal member 22 heats the fixing belt 21 with reduced heat at the nip N. Consequently, the recording medium P discharged from the nip N has a decreased temperature compared to when the recording medium P enters the nip N. In other words, at the exit of the nip N, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion 22*a* of the metal member 22 into which the stationary member 26 is inserted so as to support the metal member 22.

In this exemplary embodiment, a stainless steel sheet having a thickness of approximately 0.1 mm is bent into the substantially cylindrical metal member 22. However, spring-back of the stainless steel sheet may expand a circumference of the metal member 22, and therefore the stainless steel sheet may maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21. To address this problem, according to this exemplary embodiment, the stay 28 supports and holds the concave portion (bent portion) 22*a* of the metal member 22 provided with an opening so as to prevent deformation of the metal member 22 due to spring-back. For example, the stay 28 is press-fitted to the concave portion 22*a* of the metal member 22 to contact the inner circumferential surface of the metal member 22 while the shape of the metal member 22 that is bent against spring-back of the stainless steel sheet is maintained.

Preferably, the metal member 22 has a thickness not greater than approximately 0.2 mm to increase heating efficiency of the metal member 22.

As described above, the substantially cylindrical-shaped metal member 22 may be formed by bending sheet metal into the desired shape. Sheet metal is used to give the metal member 22 a thin thickness to shorten warm-up time. However, such a thin metal member 22 has little rigidity, and therefore may be easily bent or deformed by pressure applied by the pressing roller 31. Accordingly, the deformed metal member 22 may not provide a desired nip length of the nip N, resulting in degraded fixing property. To address such a challenge, according to this exemplary embodiment, the concave portion 22*a* of the thin metal member 22 into which the stationary member 26 is inserted is spaced away from the nip N to prevent the metal member 22 from receiving pressure from the pressing roller 31 directly.

Figure 5:
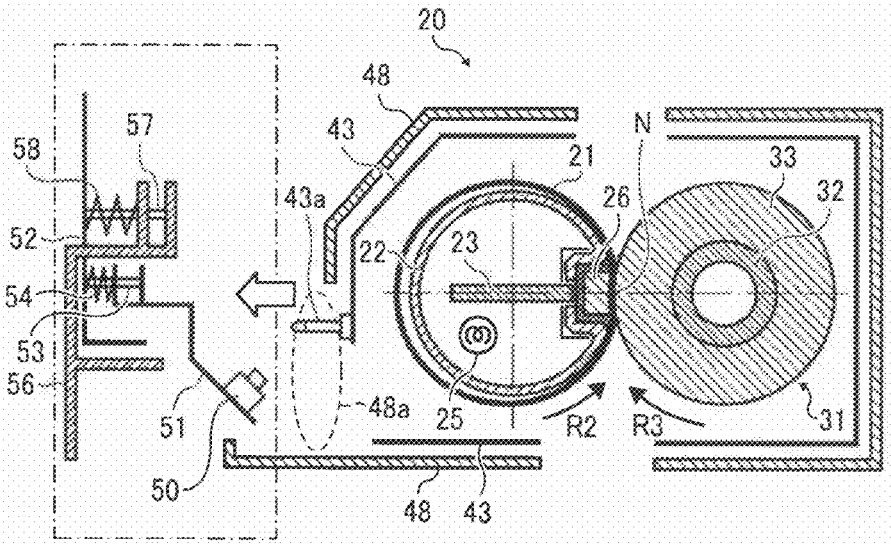
FIG. 5 is a sectional view of a state in which the fixing device of FIG. 2 is installed in the image forming apparatus illustrated in FIG. 1.

As illustrated in FIGS. 2 and 5, in the fixing device 20 according to this exemplary embodiment, for example, the fixing belt 21, the metal member 22, the stationary member 26, the heater 25, the reinforcement member 23, and the pressing roller 31 are directly or indirectly supported by the fixing frame (housing) 43 made of, e.g., metal. The fixing frame 43 includes a positioning pin 43*a* to position the fixing device 20 removably installed in the image forming apparatus 1.

The fixing device 20 also includes an outer fixing cover 48 to cover the fixing belt 21, the metal member 22, the stationary member 26, the heater 25, the reinforcement member 23, the pressing roller 31, and the fixing frame 43. The outer fixing cover 48 includes a heat-resistant resin material and almost entirely covers the fixing device 20. In such a configuration, when a user or service person removes and install the fixing device 20 or clear a paper jam, the outer fixing cover 48 prevents the user or service person from directly touching the fixing frame 43 or other member heated to a high temperature through the fixing process.

In this exemplary embodiment, as illustrated in FIG. 5, the outer fixing cover 48 has an opening 48*a* from which a portion of the surface of the fixing belt 21 is exposed to the outside of the fixing device 20 via the fixing frame 43. Through the opening 48*a* of the outer fixing cover 48, the temperature sensor 50 provided at the image forming apparatus 1 is introduced into and drawn from the fixing device 20 in accordance with the installation and removal of the fixing device 20 to and from the image forming apparatus 1. The positioning pin 43*a* on the fixing frame 43 engages the sensor bracket 51 serving as a support member provided at the image forming apparatus 1. It is preferable that, while performing the above-described function, the opening 48*a* is as small as possible so as to prevent users and service persons from accidentally touching components within the fixing device.

The following describes operation of the fixing device 20 having the above-described structure. When the image forming apparatus 1 is powered on, power is supplied to the heater 25. Simultaneously, a driving force of a driving motor is transmitted to the pressing roller 31, and the pressing roller 31 starts rotating in the rotation direction R3. Thus, friction takes place between the pressing roller 31 and the fixing belt 21 at the nip and rotates the fixing belt 21 in the rotation direction R2.

At the second transfer nip, a color toner image is transferred from the intermediate transfer belt 78 onto the recording medium P. A guide plate guides the recording medium P bearing the toner image T in a direction Y10 so that the recording medium P enters the nip N formed between the fixing belt 21 and the pressing roller 31 pressed against each other. At the nip N, simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. The recording medium P bearing the fixed toner image T discharged from the nip N is conveyed in a direction Y11.

Below, configuration and operation of the image forming apparatus 1 according to this exemplary embodiment are described.

As illustrated in FIGS. 2 and 5, the image forming apparatus 1 includes the temperature sensor 50 serving as the temperature detector, the sensor bracket 51, an apparatus-side bracket 52, an apparatus-side cover 56, studs 53 and 57, and compression springs 54 and 58. On the other hand, in the fixing device 20, the outer fixing cover 48 has the opening 48*a* and the fixing frame 43 has an opening.

As illustrated in FIG. 3, with the fixing device 20 installed in the fixing device 20, the temperature sensor 50 is disposed opposing the fixing belt 21 with a certain clearance between it and the fixing belt 21 to detect the surface temperature of the fixing belt 21. The temperature sensor 50 is, for example, a thermopile or non-contact-type thermistor. Use of the non-contact-type temperature sensor 50 prevents wear of the fixing belt 21 and the temperature sensor 50.

The sensor bracket 51 supports the temperature sensor 50 so that the temperature sensor 50 is introduced to the inside of the outer fixing cover 48 through the opening 48*a* upon installation of the fixing device 20 in the image forming apparatus 1.

For example, as illustrated in FIG. 5, as the fixing device 20 is installed in the image forming apparatus 1 (indicated by a dash-and-dot line) in a direction indicated by a blank arrow, the temperature sensor 50 supported by the sensor bracket 51 (and also supported by the apparatus-side bracket 52) enters from the opening 48*a* to the inside of the outer fixing cover 48 without contacting any components in the fixing device 20. Finally, as illustrated in FIG. 2, the temperature sensor 50 supported by the sensor bracket 51 is positioned opposite the fixing belt 21 inside the outer fixing cover 48 and is used to control the temperature of the fixing belt 21. Likewise, when the fixing device 20 is removed from the image forming apparatus 1 in a direction opposite the direction indicated by the blank arrow in FIG. 5, the temperature sensor 50 supported by the sensor bracket 51 is drawn from the opening 48*a* to the outside of the outer fixing cover 48 without contacting any components in the fixing device 20.

As described above, the relatively costly, non-contact-type temperature detector is provided not to the fixing device 20 but to the image forming apparatus 1. Such a configuration can reduce the cost of the fixing device 20 manufactured as a replaceable unit.

In addition, with the temperature sensor 50 being covered by the outer fixing cover 48, the temperature sensor 50 provided at the image forming apparatus 1 detects the temperature of the fixing belt 21. Such a configuration prevents precise detection of the surface temperature of the fixing belt 21 from being obstructed by noise in the ambient temperature of the temperature detector caused by air flow inside the image forming apparatus 1. That is, covered with the outer fixing cover 48, the temperature sensor 50 can detect the surface temperature of the fixing belt 21 with high precision, thus preventing fixing failure of a resultant image.

In the image forming apparatus 1 with the fixing device 20 installed, the apparatus-side cover 56 covers the opening 48*a* from the outside of the outer fixing cover 48.

The apparatus-side cover 56 is formed with heat-resistant resin material and supported by the apparatus-side bracket 52 is fixedly provided at a housing of the image forming apparatus 1. Specifically, the apparatus-side cover 56 is supported in the image forming apparatus 1 so that the apparatus-side cover 56 is urged in a direction opposite the direction (indicated by the blank arrow of FIG. 5) in which the fixing device 20 is installed in the image forming apparatus 1. With the fixing device 20 installed in the image forming apparatus 1, the apparatus-side cover 56 closely contacts the outer fixing cover 48 to cover the opening 48*a*.

The stud 57 is fixed on the apparatus-side bracket 52. The apparatus-side cover 56 has a through hole through which the stud 57 is inserted. The compression spring 58 is coiled around the stud 57 to bias the apparatus-side bracket 52 and the apparatus-side cover 56 so as to move the apparatus-side cover 56 away from the apparatus-side bracket 52. With such a configuration, when the fixing device 20 is not installed in the image forming apparatus 1 (as illustrated in FIG. 5), the apparatus-side cover 56 is biased by a spring force of the compression spring 58 toward the right side in FIG. 5 with respect to the apparatus-side bracket 52 fixed at the image forming apparatus 1 and positioned at a position at which the apparatus-side bracket 52 and the apparatus-side cover 56 contact each other. Thus, the apparatus-side cover 56 is biased so as to be reciprocally movable in the horizontal direction in FIG. 5.

When the fixing device 20 is installed in the image forming apparatus 1, the apparatus-side cover 56 closely contacts the outer fixing cover 48 by the spring force of the compression spring 58 at positions indicated by broken-line circles in FIG. 2. Specifically, the apparatus-side cover 56 is positioned at a position at which the apparatus-side cover 56 is slightly shifted to the left side in FIG. 2 by the outer fixing cover 48. That is, even if the components of the image forming apparatus 1 and/or the fixing device 20 are somewhat less than perfectly accurately dimensioned, the above-described configuration allows the outer fixing cover 48 to closely contact the apparatus-side cover 56.

Thus, the opening 48*a* of the outer fixing cover 48 is sealed by the apparatus-side cover 56, thus isolating the temperature sensor 50 opposing the fixing belt 21 from the interior environment of the image forming apparatus 1. Accordingly, the temperature sensor 50 can more precisely detect the surface temperature of the fixing belt 21 without being affected by air flow in the image forming apparatus 1.

Further, in this exemplary embodiment, the sensor bracket 51 is supported by the image forming apparatus 1 so that the sensor bracket 51 is biased in a direction opposite the direction indicated by the blank arrow in FIG. 5 in which the fixing device 20 is installed in the sensor bracket 51.

With the fixing device 20 installed in the image forming apparatus 1, the position of the sensor bracket 51 is determined relative to the fixing frame 43. The stud 53 is fixed on the apparatus-side bracket 52. The sensor bracket 51 has a through hole through which the stud 53 is inserted and a positioning hole to engage the positioning pin 43*a* fixed on the fixing frame 43. The compression spring 54 is coiled around the stud 53 to bias the sensor bracket 51 and the apparatus-side bracket 52 so as to move the sensor bracket 51 away from the apparatus-side bracket 52. With such a configuration, when the fixing device 20 is not installed in the image forming apparatus 1 (as illustrated in FIG. 5), the sensor bracket 51 is biased by a spring force of the compression spring 54 toward the right side in FIG. 5 with respect to the apparatus-side bracket 52 fixed at the image forming apparatus 1, and is positioned at a position at which the sensor bracket 51 and the apparatus-side bracket 52 contact each other.

Thus, the sensor bracket 51 is biased so as to be reciprocally movable in the horizontal direction in FIG. 5. When the fixing device 20 is installed in the image forming apparatus 1, the sensor bracket 51 is pressed against the fixing frame 43 by the spring force of the compression spring 54 while engaging the positioning pin 43*a*. The sensor bracket 51 is positioned at a position at which the sensor bracket 51 is slightly shifted to the left side in FIG. 2 by the fixing frame 43. That is, even if the dimensions of components of the image forming apparatus 1 and/or the fixing device 20 are somewhat less accurate, the above-described configuration allows the sensor bracket 51 to be accurately positioned using the positioning pin 43*a*.

Such accurate positioning of the sensor bracket 51 can enhance the positional accuracy of the temperature sensor 50 opposing the fixing belt 21, thus allowing the temperature sensor 50 to more precisely detect the surface temperature of the fixing belt 21.

As illustrated in FIG. 2, with the fixing device 20 installed in the image forming apparatus 1, the temperature sensor 50 is supported by the sensor bracket 51 in a manner that the temperature sensor 50 opposes the fixing belt 21 within a range extending from a position just under the fixing belt 21 to a position horizontal with the fixing belt 21. Specifically, as illustrated in FIG. 2, the temperature sensor 50 is disposed opposing the fixing belt 21 in a range indicated by a lower left area (e.g., the third quadrant in FIG. 2) demarcated by horizontal and vertical lines passing the center of the fixing belt 21. That is, the temperature sensor 50 is disposed at an obliquely downward position relative to the fixing belt 21.

Such a configuration allows the temperature sensor 50 to detect the temperature of the fixing belt 21 with high precision and substantially without being affected by heated air rising in the fixing device 20 or evaporation of components contained in toner.

As described above, in this exemplary embodiment, the non-contact-type temperature sensor 50 serving as the temperature detector is provided at the image forming apparatus 1 and introduced to the inside of the outer fixing cover 48 through the opening 48*a* of the outer fixing cover 48 upon installation of the fixing device 20 in the image forming apparatus 1. Such a configuration prevents wear of the fixing belt 21 and the temperature sensor 50, thus allowing the fixing device 20 to be produced thus at a relatively low cost. Further, the surface temperature of the fixing belt 21 can be detected using the temperature sensor 50 without being affected by air flow inside the image forming apparatus 1.

In this exemplary embodiment, the sensor bracket 51 and the apparatus-side cover 56 are biased by the compression springs 54 and 58, respectively. However, it is to be noted that such biasing members are not limited to the sensor bracket 51 and the apparatus-side cover 56 and may be, for example, leaf springs or other suitable type of biasing members. Such a configuration can also obtain effects equivalent to the effects of this exemplary embodiment.

Second Exemplary Embodiment

Next, a second exemplary embodiment of the present disclosure is described with reference to FIG. 6.

Figure 6:
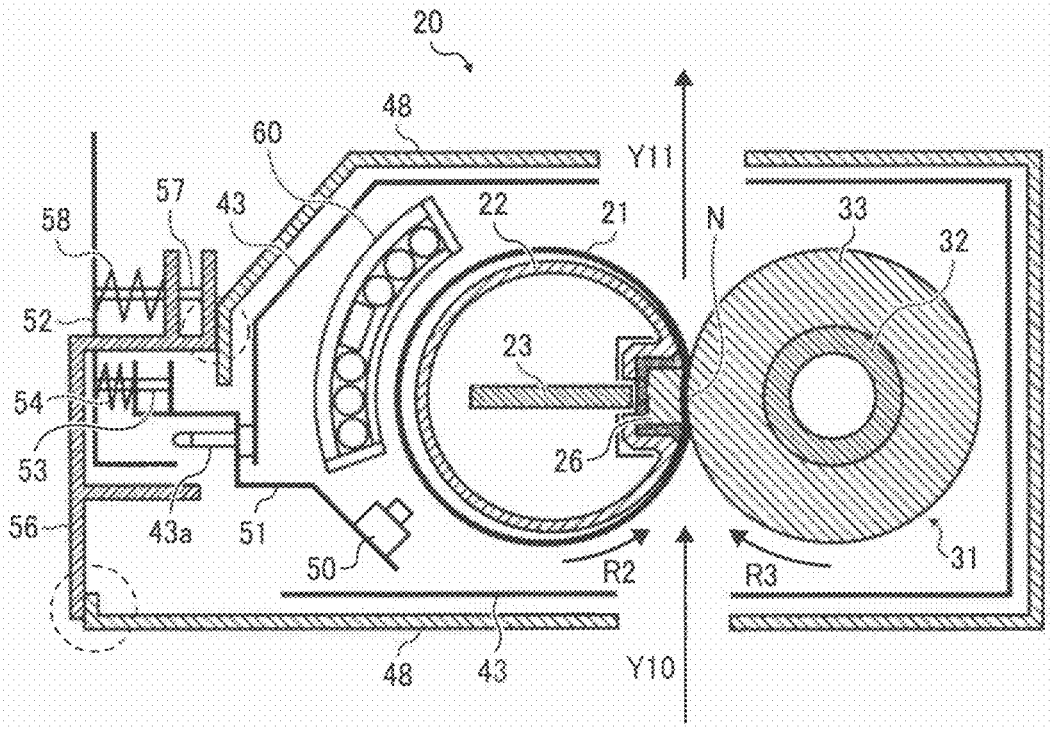
FIG. 6 is a schematic view of a state in which a fixing device is installed in an image forming apparatus according to an exemplary embodiment of the present disclosure.

FIG. 6 is a schematic view of a state in which a fixing device 20 is installed in an image forming apparatus according to the second exemplary embodiment of the present disclosure. For the fixing device 20 illustrated in FIG. 6, the metal member 22 is heated by electromagnetic induction, which differs from the fixing device illustrated in 5A.

As with the fixing device 20 illustrated in FIG. 2, the fixing device 20 illustrated in FIG. 6 also includes a fixing belt 21 serving as a belt member, a stationary member 26, a metal member 22 of a substantially cylindrical shape, a reinforcement member 23, a heat insulator 27, a pressing roller 31 serving as a rotary pressing member. As with the image forming apparatus illustrated in FIG. 2, the image forming apparatus illustrated in FIG. 6 also includes a temperature sensor 50 serving as a temperature detector, a sensor bracket 51, an apparatus-side bracket 52, an apparatus-side cover 56, studs 53 and 57, compression springs 54 and 58. Further, as with the above-described exemplary embodiment, upon installation and removal of the fixing device 20 to and from the image forming apparatus 1, the temperature sensor 50 provided at the image forming apparatus 1 is introduced into the fixing device 20, more specifically, the inside of an outer fixing cover 48.

The fixing device 20 includes an induction heater 60 as a heating unit, instead of the heater 25 illustrated in FIG. 2. In the above-described fixing device 20 illustrated in FIG. 2, radiation heat from the heater 25 heats the metal member 22. By contrast, in the fixing device 20 illustrated in FIG. 6, the induction heater 60 heats the metal member 22 by electromagnetic induction.

The induction heater 60 includes an exciting coil, a core, and a coil guide. The exciting coil includes litz wires formed of a bundle of thin wires, which extend in the axial direction of the fixing belt 21 (e.g., a direction perpendicular to a surface of a sheet on which FIG. 6 is printed) to cover a part of the fixing belt 21. The coil guide includes heat-resistant resin and holds the exciting coil and the core. The core is a semi-cylindrical member including a ferromagnet having a relative magnetic permeability in a range of from approximately 1,000 to approximately 3,000, such as ferrite. The core includes a center core and a side core to generate magnetic fluxes toward the metal member 22 effectively. The core is disposed opposite the exciting coil extending in the width direction of the fixing belt 21.

Operation of the fixing device 20 having the above-described structure is described below.

The induction heater 60 heats the fixing belt 21 rotating in the rotation direction R2 at a position at which the fixing belt 21 faces the induction heater 60. Specifically, a high-frequency alternating current is applied to the exciting coil to generate magnetic lines of force around the metal member 22 in such a manner that the magnetic lines of force are alternately switched back and forth. Accordingly, an eddy current is generated on the surface of the metal member 22, and electric resistance of the metal member 22 generates Joule heat. The Joule heat heats the metal member 22 by electromagnetic induction, and the heated heating member 22 heats the fixing belt 21.

In order to heat the metal member 22 effectively by electromagnetic induction, the induction heater 60 may face the metal member 22 in an entire circumferential direction of the metal member 22. The metal member 22 may include nickel, stainless steel, iron, copper, cobalt, chrome, aluminum, gold, platinum, silver, tin, palladium, and/or an alloy of a plurality of those metals, or the like.

As described above, as with the above-described embodiment, the non-contact-type temperature sensor 50 in the second exemplary embodiment is also provided at the image forming apparatus 1 and introduced to the inside of the outer fixing cover 48 through the opening 48*a* of the outer fixing cover 48 upon installation of the fixing device 20 in the image forming apparatus 1. Such a configuration prevents wear of the fixing belt 21 and the temperature sensor 50, thus allowing the fixing device 20 to be produced thus at a relatively low cost. Further, the surface temperature of the fixing belt 21 can be detected using the temperature sensor 50 without being affected by air flow inside the image forming apparatus 1.

As described above, for the fixing device 20 illustrated in FIG. 6, the induction heater 60 heats the metal member 22 by electromagnetic induction. Alternatively, a resistance heat generator may heat the metal member 22. For example, the resistance heat generator may contact an inner circumferential surface of the metal member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases the temperature of the resistance heat generator. Accordingly, the resistance heat generator heats the metal member 22 contacted by the resistance heat generator. Consequently, the heated metal member 22 heats the fixing belt 21. Such a configuration can obtain effects equivalent to the effects obtained by the fixing device 20 described above.

In each of the above-described exemplary embodiments, a fixing belt having the multi-layer structure is used as the fixing belt 21. Alternatively, an endless fixing film including polyimide, polyamide, fluorocarbon resin, and/or metal may be used as a fixing belt to provide effects equivalent to the effects provided by the fixing device 20 described above.

In each of the above-described exemplary embodiments, the fixing belt 21 including the metal member 22 within the loop thereof is used as the fixing member. However, it is to be noted that the fixing device is not limited to such a belt fixing device and may use, for example, a fixing roller as the fixing member or a pressing belt or a pressing pad as the pressing member.

In such a case, the non-contact-type temperature sensor serving as the temperature detector is also provided at the image forming apparatus and introduced to the inside of the outer fixing cover through the opening of the outer fixing cover upon installation of the fixing device in the image forming apparatus. Such a configuration can obtain effects equivalent to the effects of each of the above-described exemplary embodiment.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a fixing device removably installable in the image forming apparatus, the fixing device including a rotary fixing member to thermally fuse a toner image on a recording medium, a fixing frame to directly or indirectly support the rotary fixing member, and an outer fixing cover provided separate from the fixing frame so as to cover the rotary fixing member and the fixing frame and have an opening from which a portion of a surface of the rotary fixing member is exposed to the outside of the fixing device;

a temperature detector disposed opposing the rotary fixing member to detect a temperature of the surface of the rotary fixing member without contacting the rotary fixing member when the rotary fixing member is installed in the image forming apparatus;

a support member supporting the temperature detector to introduce the temperature detector into the inside of the outer fixing cover through the opening of the outer fixing cover upon installation of the rotary fixing member in the image forming apparatus;

an apparatus-side cover to cover the opening from the outside of the outer fixing cover, the apparatus-side cover is supported by the image forming apparatus, biased in a direction opposite a direction in which the fixing device is installed in the image forming apparatus, and the apparatus-side cover is configured to contact the outer fixing cover to cover the opening with the fixing device being installed in the image forming apparatus, wherein the support member is fixed to the image forming apparatus and biased in the direction opposite the direction in which the fixing device is installed in the image forming apparatus, and the support member is configured to be pressed against the fixing frame with the fixing device installed in the image forming apparatus.

2. The image forming apparatus according to claim 1, wherein the support member is supported by the image forming apparatus, biased in a direction opposite a direction in which the fixing device is installed in the image forming apparatus, and positioned relative to the fixing frame with the fixing device being installed in the image forming apparatus.

3. The image forming apparatus according to claim 1, wherein, with the fixing device installed in the image forming apparatus, the temperature detector is supported opposing the rotary fixing member by the support member within a range extending from a position just under the rotary fixing member to a position horizontal with the rotary fixing member.

4. The image forming apparatus according to claim 1, wherein the rotary fixing member is an endless flexible fixing belt, and the fixing device comprises:

a hollow, substantially cylindrical metal member around which the flexible fixing belt is rotated;

a heater disposed near the metal member to heat the metal member and thus heat the fixing belt;

a stationary member disposed inside an endless loop formed by the fixing belt rotated around the metal member; and a rotary pressure member pressed against the stationary member via the fixing belt to form a nip between the rotary pressure member and the stationary member.

5. The image forming apparatus according to claim 4, further comprising a reinforcement member disposed in contact with the stationary member inside the substantially cylindrical metal member to reinforce the stationary member, wherein the metal member is disposed opposing the inner circumferential surface of the fixing belt over an area other than the nip.

* * * * *